US005396999A

United States Patent [19]

Sandheinrich

[11] Patent Number: 5,396,999

[45] Date of Patent: Mar. 14, 1995

[54] LUNCH BOX CONTAINER WITH MAGNETIC INSERTS

[76] Inventor: Barbara R. Sandheinrich, 6621 Zion Church Rd., Sparta, Ill. 62286

[21] Appl. No.: 78,926

[22] Filed: Jun. 21, 1993

[51] Int. Cl.[6] ..... A45C 11/20

[52] U.S. Cl. ..... 206/542; 206/541; 206/818; 40/152.2; 40/547; 40/600

[58] Field of Search ..... 206/541, 542, 546, DIG. 818; 40/152, 152.2, 547, 600

[56] References Cited

U.S. PATENT DOCUMENTS

| | | | |
|---|---|---|---|
| 2,549,928 | 4/1951 | Reefe | 40/152.2 |
| 2,646,636 | 7/1953 | Gandee | 40/152.2 |
| 3,124,501 | 3/1964 | Wise | 40/600 |
| 3,777,418 | 12/1973 | Cooper | 206/542 |
| 3,965,599 | 6/1976 | Ebner | 40/600 |
| 4,216,862 | 8/1980 | Daenen | 206/459.5 |
| 4,484,682 | 11/1984 | Crow | 206/541 |
| 5,005,306 | 4/1991 | Kinstler | 40/600 |

*Primary Examiner*—Paul T. Sewell
*Assistant Examiner*—Thomas P. Hilliard
*Attorney, Agent, or Firm*—E. Michael Combs

[57] ABSTRACT

A lunch box container including a bottom wall and a hingedly mounted top wall includes ferrous metallic floors directed into the bottom and top walls recessed relative to the bottom and top walls respectively to receive and secure ferromagnetic inserts to permit configurational changes to the lunch box structure to enhance continued use by individuals. A modification of the invention includes illumination frameworks arranged to direct illumination onto inserts within the frameworks.

4 Claims, 4 Drawing Sheets

LUNCH BOX CONTAINER WITH MAGNETIC INSERTS

BACKGROUND OF THE INVENTION

1. Field of the Invention

The field of invention relates to lunch box container structure, and more particularly pertains to a new and improved lunch box container arranged to accommodate lunch box container configurational inserts for display and enhanced amusement of individuals.

2. Description of the Prior Art

Display containers of various types per se are utilized in the prior art such as exemplified by the U.S. Pat. Nos. 3,762,544 and 3,884,349.

Lunch box structure having selective displays are indicated in the U.S. Pat. Nos. 4,216,862 and 5,054,611.

The instant invention attempts to overcome deficiencies of the prior art by providing for a decorative display for identification and enhanced amusement of individuals in use providing for ferromagnetic inserts arranged for mounting within the wall structure of the lunch box container and in this respect, the present invention substantially fulfills this need.

SUMMARY OF THE INVENTION

In view of the foregoing disadvantages inherent in the known types of lunch box container structure now present in the prior art, the present invention provides a lunch box container wherein the same is arranged to mount ferromagnetic inserts onto the wall structure of the lunch box for display and amusement. As such, the general purpose of the present invention, which will be described subsequently in greater detail., is to provide a new and improved lunch box container which has all the advantages of the prior art lunch box container structure and none of the disadvantages.

To attain this, the present invention provides a lunch box container including a bottom wall and a hingedly mounted top wall, including ferrous metallic floors directed into the bottom and top walls recessed relative to the bottom and top walls respectively to receive and secure ferromagnetic inserts to permit configurational changes to the lunch box structure to enhance continued use by individuals. A modification of the invention includes illumination frameworks arranged to direct illumination onto inserts within the frameworks.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, or is it intended to be limiting as to the scope of the invention in any way.

It is therefore an object of the present invention to provide a new and improved lunch box container which has all the advantages of the prior art lunch box container structure and none of the disadvantages.

It is another object of the present invention to provide a new and improved lunch box container which may be easily and efficiently manufactured and marketed.

It is a further object of the present invention to provide a new arid improved lunch box container which is of a durable and reliable construction.

An even further object of the present invention is to provide a new and improved lunch box container which is susceptible of a low cost of manufacture with regard to both materials and labor, and which accordingly is then susceptible of low prices of sale to the consuming public, thereby making such lunch box containers economically available to the buying public.

Still yet another object of the present invention is to provide a new and improved lunch box container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
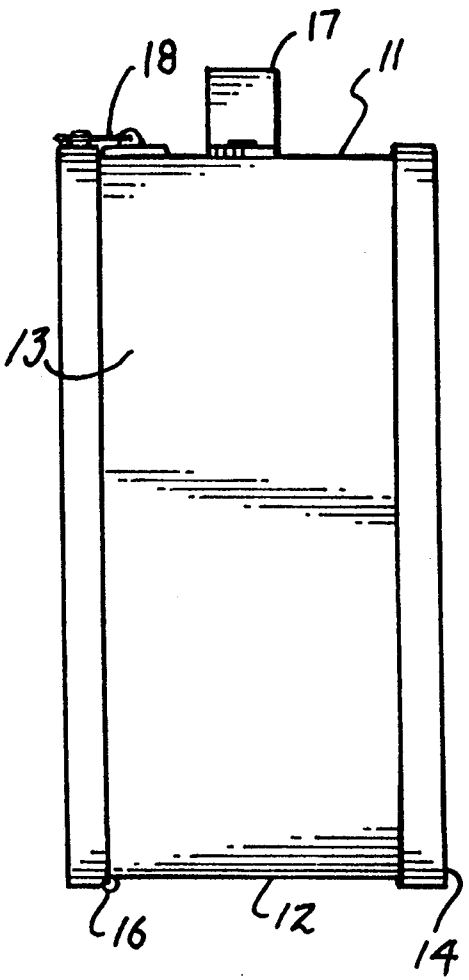
FIG. 2 is an orthographic end view of the invention.
Figure 1:
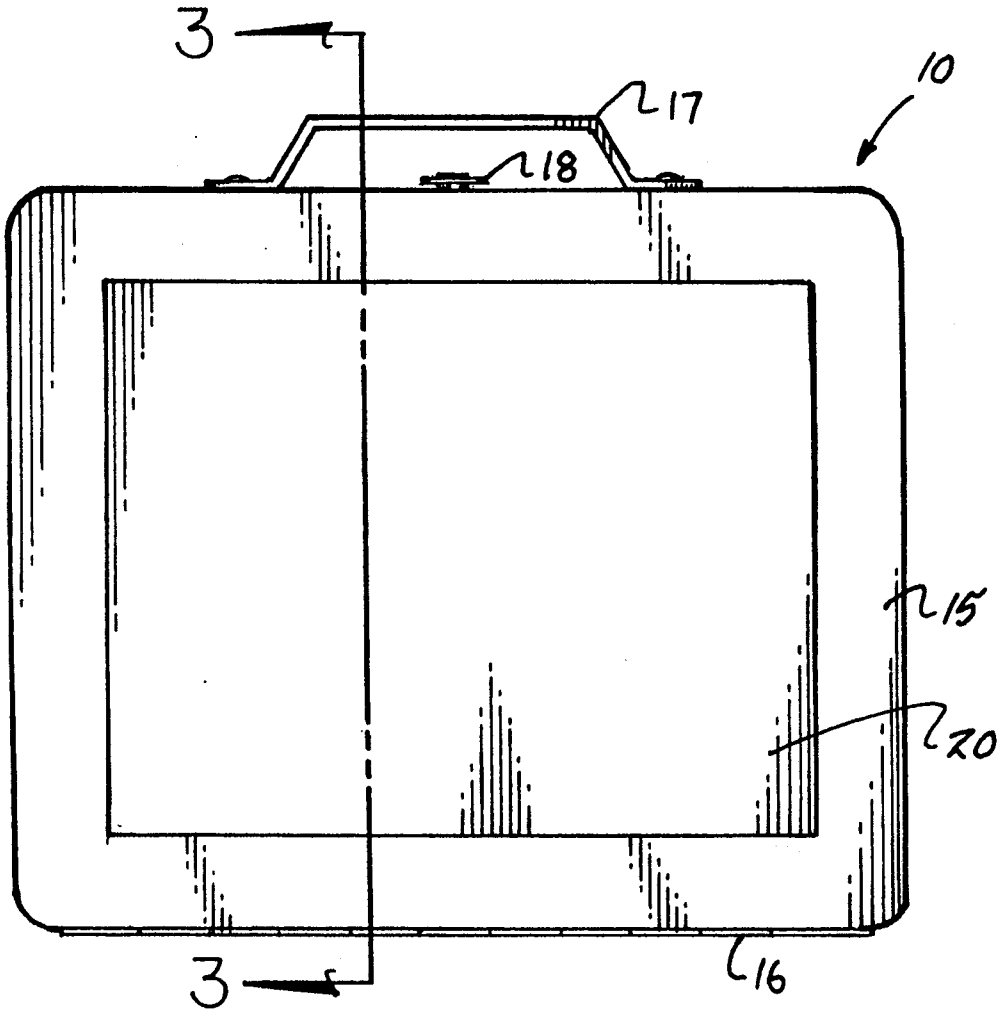
FIG. 1 is an orthographic view of the invention.
Figure 4:
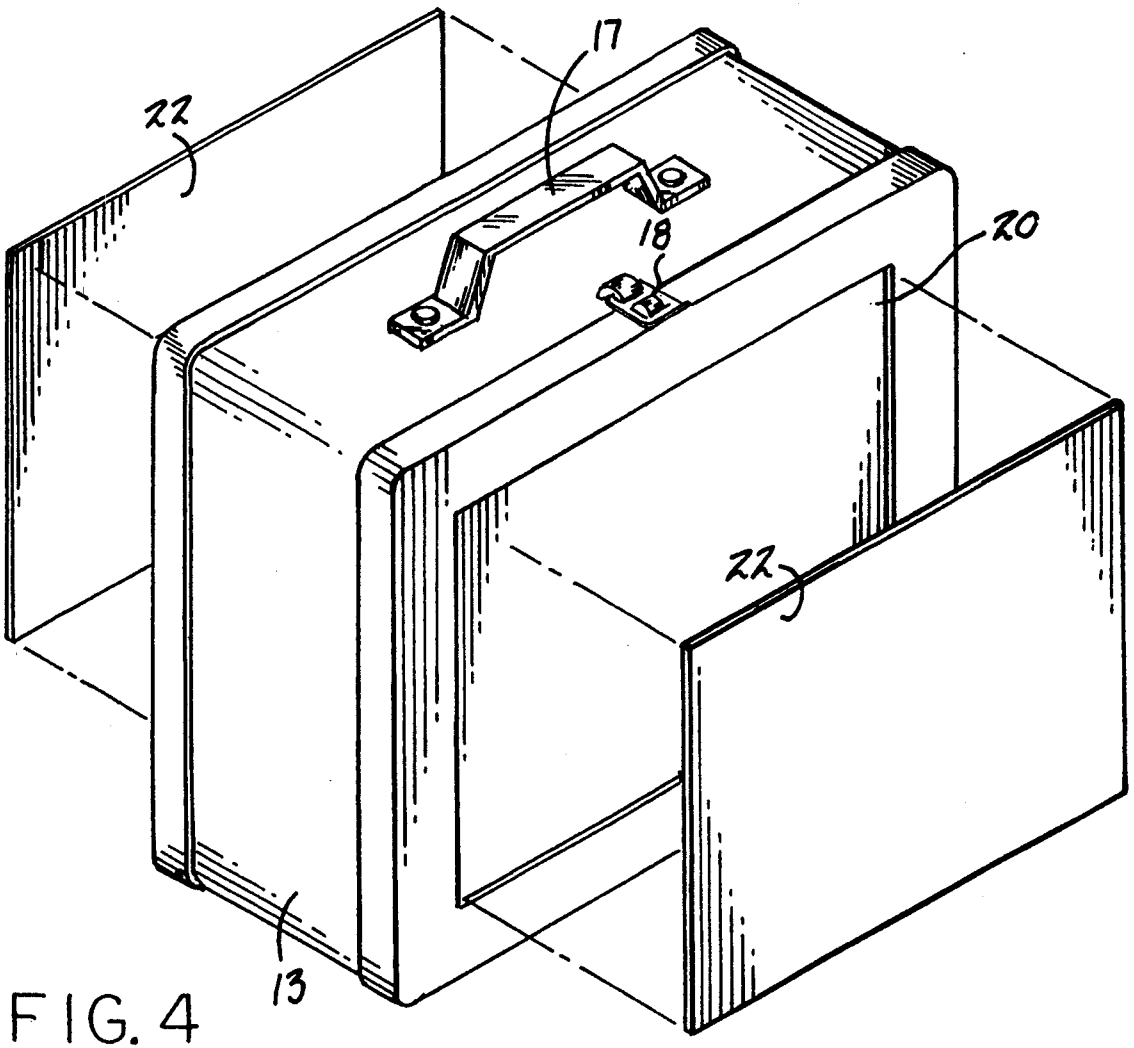
FIG. 4 is an isometric illustration of the invention arranged to receive exemplary ferromagnetic inserts.
Figure 3:
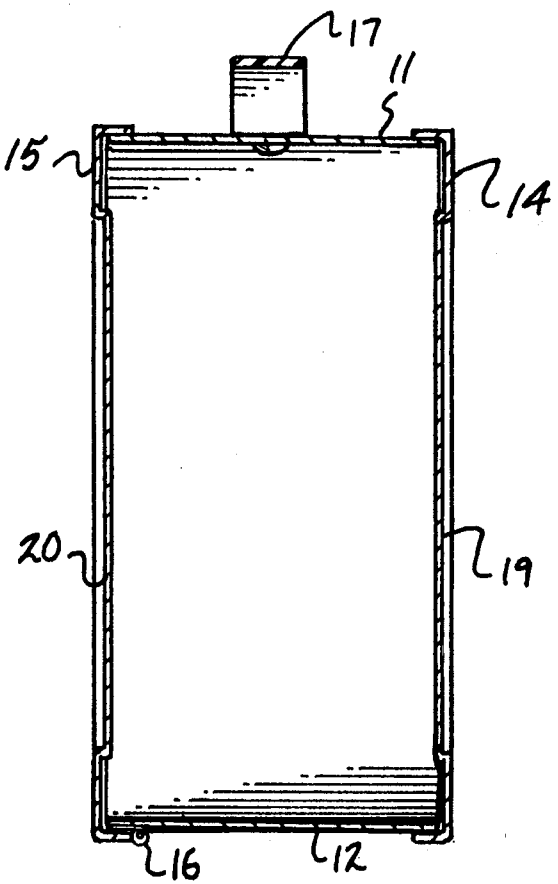
FIG. 3 is an orthographic view, taken along the lines 3—3 of FIG. 1 in the direction indicated by the arrows.

With reference now to the drawings, and in particular to FIGS. 1 to 8 thereof, a new and improved lunch box container embodying the principles and concepts of the present invention and generally designated by the reference numerals 10 and 10*a* will be described.

Figure 5:
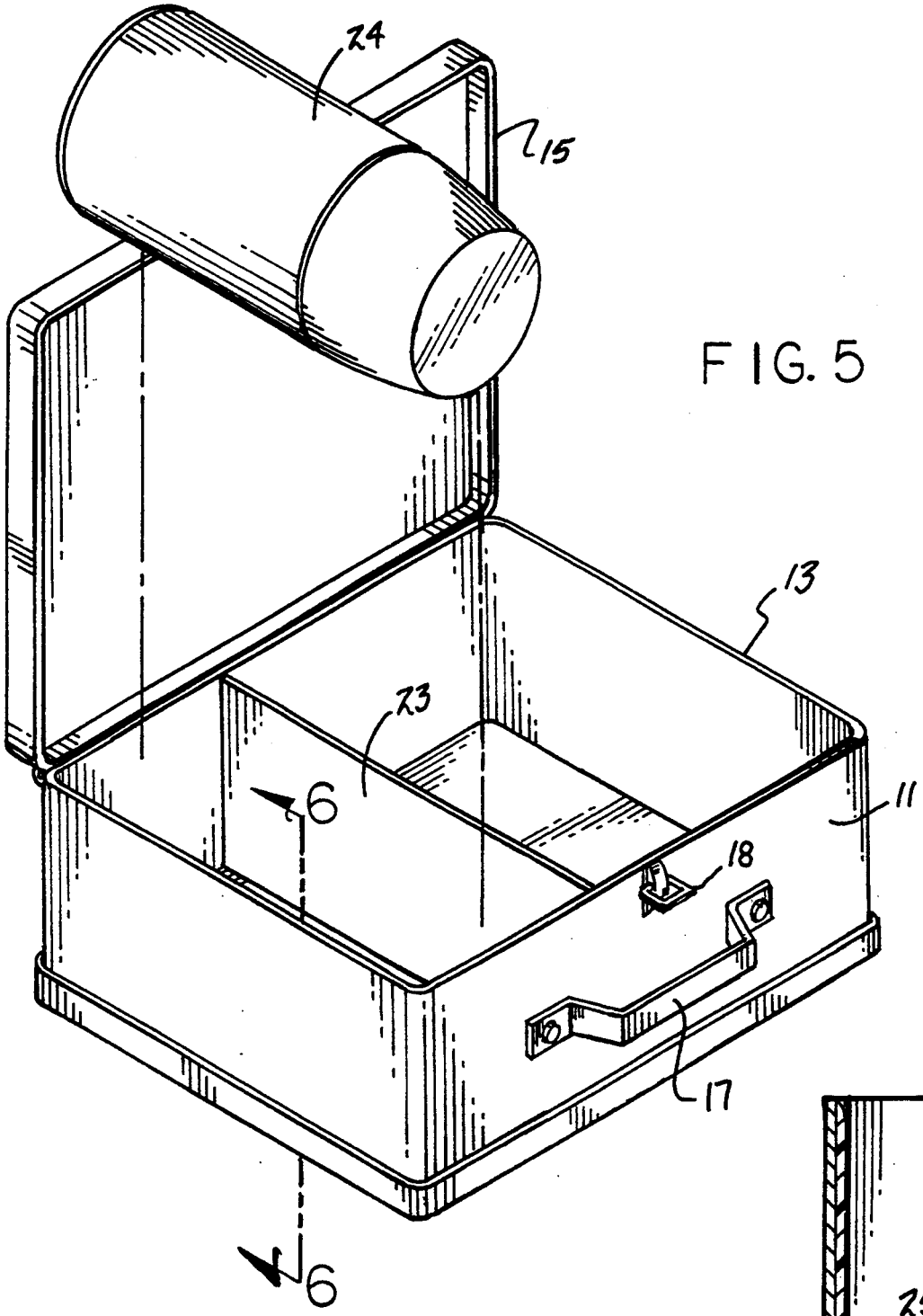
FIG. 5 is an isometric illustration of the interior component construction of the invention.

More specifically, the lunch box container 10 of the instant invention essentially comprises a container front wall 11 paced from a container rear wall 12, having container side walls 13, with a container bottom wall 14 spaced from a container top wall lid 15. The container top wall lid 15 is hingedly mounted about a hinge 16 to the rear wall 12. A handle 17 is mounted to the front wall 11 for ease of transport of the organization, with a latch 18 arranged for securement of the lid to the container structure permitting access interiorly of the container upon release of the latch 18 relative to the lid 15, in a manner as indicated in FIG. 5, to secure a thermos container 24 within the container to one of the side walls 13 and a partition wall 23 within the container structure. Respective bottom and top walls 14 and 15 include respective bottom and top wall recess floors 19 and 20 respectively formed of a ferrous metallic material and of planar construction parallel relative to one another to receive respective first and second inserts 21 and 22, each formed of a ferrous magnetic material. The floors 19 and 20 are recessed below the respective bottom and top walls 14 and 15 a predetermined height, wherein the inserts 21 and 22 are of a predetermined thickness substantially equal to the predetermined height to prevent dislodgement of the inserts. The inserts may be of any geometric configuration to enhance amusement of individuals and to this end, a plurality of such inserts may be provided, wherein by way of example the rectilinear configuration as illustrated may be of a contrasting coloration relative to the box structure, wherein it is understood that various configurations and colorations may be provided, each of said predetermined thickness.

Figure 6:
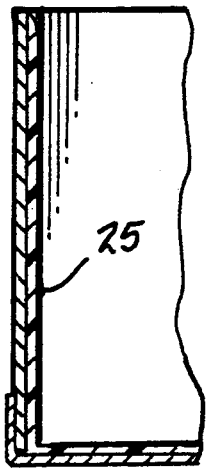
FIG. 6 is an orthographic view, taken along the lines 6—6 of FIG. 5 in the direction indicated by the arrows.

The FIG. 6 indicates the wall structure of the container having a polymeric liner 25 coextensive therewith to provide for protection of the wall structure from food components and the like stored within the container and transported therewithin.

Figure 7:
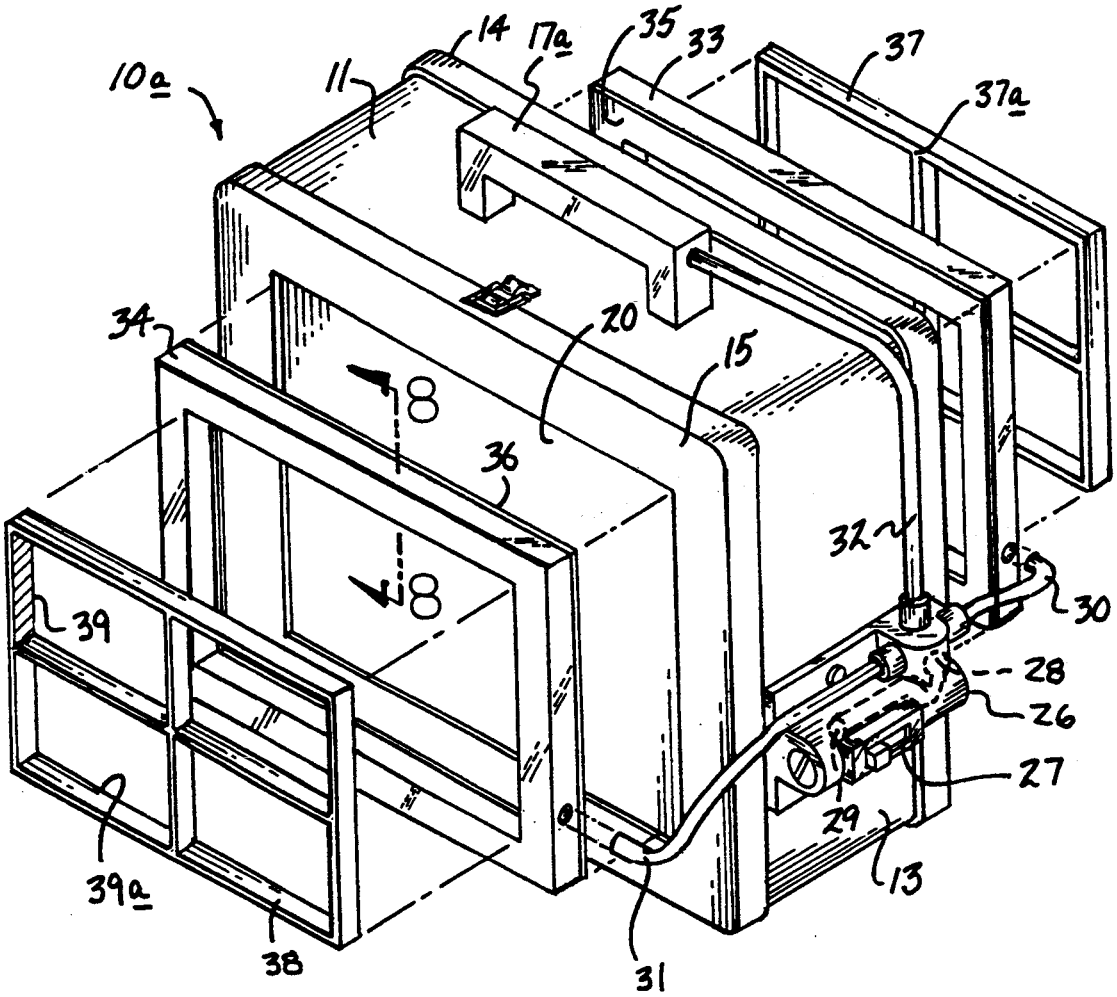
FIG. 7 is an isometric illustration of a modified aspect of the invention.
Figure 8:
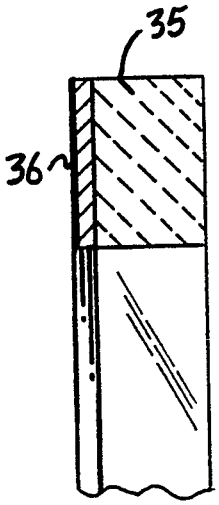
FIG. 8 is an orthographic view, taken along the lines 8—8 of FIG. 7 in the direction indicated by the arrows.

The FIGS. 7 and 8 indicates the use of a modified lunch box container 10*a*, wherein to this end, an illumination housing 26 is mounted to one of the side walls 13. The illumination housing 26 includes an on/off switch 27 cooperative and in electrical communication with an illumination bulb 28 through a battery 29 to effect selective illumination of the illumination bulb 28 within the housing 26.

The first and second floors 19 and 20, as illustrated in FIG. 7, are arranged to receive respective first and second translucent frames 33 and 34, having respective first and second magnetic webs 35 and 36 to their respective rear faces for securement to the respective first and second floors. A first fiber optic cable 30 directed from the illumination housing 26 is positioned and directed into the housing in adjacency to the illumination bulb 28 as is the respective second and third fiber optic cables 31 and 32. The first fiber optic cable 30 is directed from the housing 26 to the first frame 33, the second fiber optic cable 31 is directed from the housing 26 to the second frame 34, with the third fiber optic cable 32 directed to a modified and translucent handle 17*a* to effect illumination of the handle permitting ease of its observation within limited available light. The first and second translucent frames 33 and 34 direct illumination onto the floor for accommodation of the various magnetic inserts 21 and 22 or alternatively, respective first and second transparent partition frames 37 and 38 are mounted to the floors 19 and 20 respectively within the respective first and second translucent frames 33 and 34 to provide for partitioning within the frames. Should an individual desire limited illumination onto various compartments within the partition frames, an opaque tape 39 is removably mounted within the partition frame 37 to prevent illumination therethrough while permitting its removal to permit illumination directed through the partition frameworks onto various magnetic inserts directed onto the floor for enhance amusement and entertainment in use of the container structure and to promote usage of the container structure 10*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled the art, it is not desired to limit the invention to the exact construction and operation shown and described, and accordingly, all suitable modifications and equivalents may be resorted to falling within the scope of the invention.

What is claimed as being new and desired to be protected by Letters Patent of the United States is as follows:

1. A lunch box container, comprising, a container having a container front wall spaced from a container rear wall, spaced container side walls, and a container bottom wall spaced from a container top wall, the top wall including a hinge hingedly mounted to the top wall to the rear wall, and a handle mounted to the front wall, and a latch secured to the front wall for selective securement to the top wall, the bottom wall including a bottom wall recessed floor recessed relative to the bottom wall, with the bottom wall arranged in surrounding relationship relative to the bottom wall floor, with the top wall having a top wall recessed floor recessed relative to the top wall, with the top wall arranged in surrounding relationship relative to the top wall floor, the bottom wall floor recessed relative to the bottom wall a predetermined height, the top wall floor recessed relative to the top wall said predetermined height, wherein the bottom wall floor and the top wall floor are formed of ferrous metallic material, and a first insert having a predetermined thickness equal to said predetermined height and formed of a ferromagnetic material is arranged for mounting to said bottom wall floor, and a second insert formed of a ferromagnetic material having a predetermined thickness equal to said predetermined height arranged in securement to said top wall floor, and an illumination housing mounted to one of said side walls, wherein the illumination housing includes a battery and an illumination bulb container therewithin, with a switch directed through said illumination housing to permit selective illumination of said illumination bulb, and a first fiber optic cable directed into said illumination housing in adjacency to said illumination bulb, a second fiber optic cable directed into said illumination housing in adjacency to said illumination bulb, and a first translucent frame having a first magnetic web mounted to said first translucent frame permitting securement of said first translucent frame to said bottom wall floor, and a second translucent frame having a second magnetic web arranged in securement to said top wall floor, said first fiber optic cable directed into said first translucent frame and said second fiber optic cable directed to said second translucent frame.

2. A container as set forth in claim 1 wherein said handle is formed of a translucent material, and a third fiber optic cable directed into said illumination housing in adjacency to said illumination bulb, and said third fiber optic cable directed from said illumination housing to said handle to effect selective illumination of said handle.

3. A container as set forth in claim 2 including a first transparent partitioned frame having a first magnetic rear face secured to said bottom wall floor within said first translucent frame, and a second transparent partitioned frame having a second magnetic rear face is secured to said top wall floor within said second translucent frame.

4. A container as set forth in claim 3 wherein an opaque tape is mounted at least within said first transparent partition frame to effect selective blocking of illumination from said first translucent frame through said first transparent partition frame.

* * * * *